US007418741B2

(12) United States Patent
Rogers

(10) Patent No.: US 7,418,741 B2
(45) Date of Patent: Sep. 2, 2008

(54) PATIENT GARMENT

(76) Inventor: Bernadine Rogers, 38540 Megan La., Westland, MI (US) 48185

( * ) Notice: Subject to any disclaimer, the term of this patent is extended or adjusted under 35 U.S.C. 154(b) by 0 days.

(21) Appl. No.: 11/269,155

(22) Filed: Nov. 8, 2005

(65) Prior Publication Data

US 2007/0157362 A1 Jul. 12, 2007

Related U.S. Application Data

(60) Provisional application No. 60/626,224, filed on Nov. 8, 2004.

(51) Int. Cl.
*A41D 13/12* (2006.01)

(52) U.S. Cl. ..... 2/114; 2/83

(58) Field of Classification Search ..... 2/114, 2/51, 48, 46, 83, 102, 94, 79, 69, 247, 249, 2/250, 251, 80, 113, 115, 244; 604/174, 604/179, 345; 128/DIG. 26
See application file for complete search history.

(56) References Cited

U.S. PATENT DOCUMENTS 4,087,864 A * 5/1978 LaBove et al. ..... 2/102
4,578,062 A 3/1986 Schneider ..... 604/174
4,637,075 A 1/1987 Ingrisano et al. ..... 2/94
4,666,432 A * 5/1987 McNeish et al. ..... 604/174
4,688,270 A 8/1987 Denicola et al. ..... 2/102
4,718,124 A * 1/1988 Sawicki et al. ..... 2/114
4,799,923 A * 1/1989 Campbell ..... 604/179
5,048,122 A * 9/1991 Prieur ..... 2/69
5,611,085 A 3/1997 Rasmussen ..... 2/102
5,897,519 A * 4/1999 Shesol et al. ..... 602/79
6,032,289 A * 3/2000 Villapiano ..... 2/102
6,460,187 B1 * 10/2002 Siegel ..... 2/114
6,477,710 B1 * 11/2002 Ojoyeyi ..... 2/69
6,574,800 B1 * 6/2003 Leger et al. ..... 2/114
6,647,552 B1 * 11/2003 Hogan ..... 2/114
6,973,673 B2 * 12/2005 Beuk ..... 2/114
7,073,204 B1 * 7/2006 Boyles ..... 2/114

* cited by examiner

*Primary Examiner*—Amy B Vanatta
(74) *Attorney, Agent, or Firm*—John R. Benefiel

(57) ABSTRACT

A patient garment for wearing during treatment or examination involving insertion of tubing at a body site which is suitable for street wear. A plurality of openable flaps allow access to particular body sites and loops attached to the garment adjacent each opening secure the tubing in position.

4 Claims, 2 Drawing Sheets

PATIENT GARMENT

CROSS REFERENCE TO RELATED PATENT APPLICATIONS

This application claims the benefit of U.S. Provisional Application No. 60/626,224 filed on Nov. 8, 2004.

BACKGROUND OF THE INVENTION

This invention concerns garments to be worn by patients while receiving medical treatment or while being examined and more particularly, in receiving treatments involving tubes inserted into the patient's body, such as for dialysis, catheters, etc. The need to obtain access to certain parts sites on a patient's body for examination or treatment requires that a patient wear a hospital gown. Such gowns are not suitable for street wear and do not allow a patient to be inhibited while moving about a hospital or other facility since they have large openings enabling ready access by medical personnel for examination or treatments. It would be desirable if such garments could be practically worn when commuting to the hospital or other medical facility to save time.

Tubes are typically taped to be held in position, but this has been found to be ineffective as the tape comes loose as the patient moves about. While garments have been developed which have improved the street wearability of the garments, the problem of the tubes attached while moving about has not been satisfactorily solved.

It is the object of the present invention to provide a garment which is suitable as street wear and also secures the tubes in position so as to allow the patient to move about freely.

SUMMARY OF THE INVENTION

The above object and other objects which will become apparent upon a reading of the following specification and claims are achieved by a patient garment which is conventional in appearance and substantially free from exposed openings but which has a plurality of openable flaps allowing openings to be formed over particular body sites such as the upper chest, arms, inner thighs of each leg or groin. The flaps may comprise covering panels mounted over openings in the garment which can be folded away after disengaging a fastening such as mating hook and loop strips to obtain access to the body sites.

Adjacent each openable panel is one or more tube holder loops formed by strips attached at each end to form a loop through which the tubes are routed to be held in position as the patient moves about. The straps can be sewn or detachably attached by fasteners such as mating hook and loop patches or strips.

DETAILED DESCRIPTION

Figure 1:
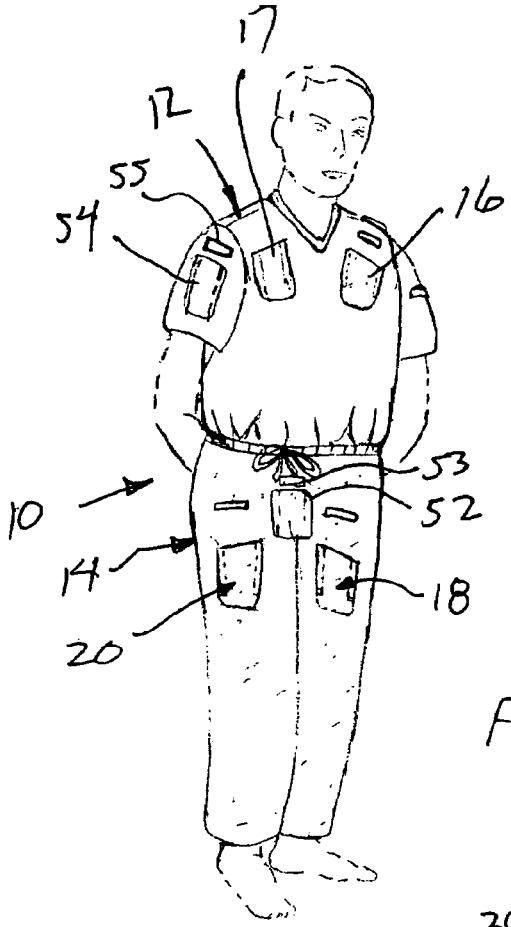
FIG. 1 is a pictorial view of a person wearing a patient garment according to the present invention.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, a patient garment 10 according to the invention comprises a two piece pant suit having a top piece 12 and a patents bottom 14. The patient garment 10 is conventionally configured but has a plurality of openable flaps including flaps 16, 18, 20.

Figure 2:
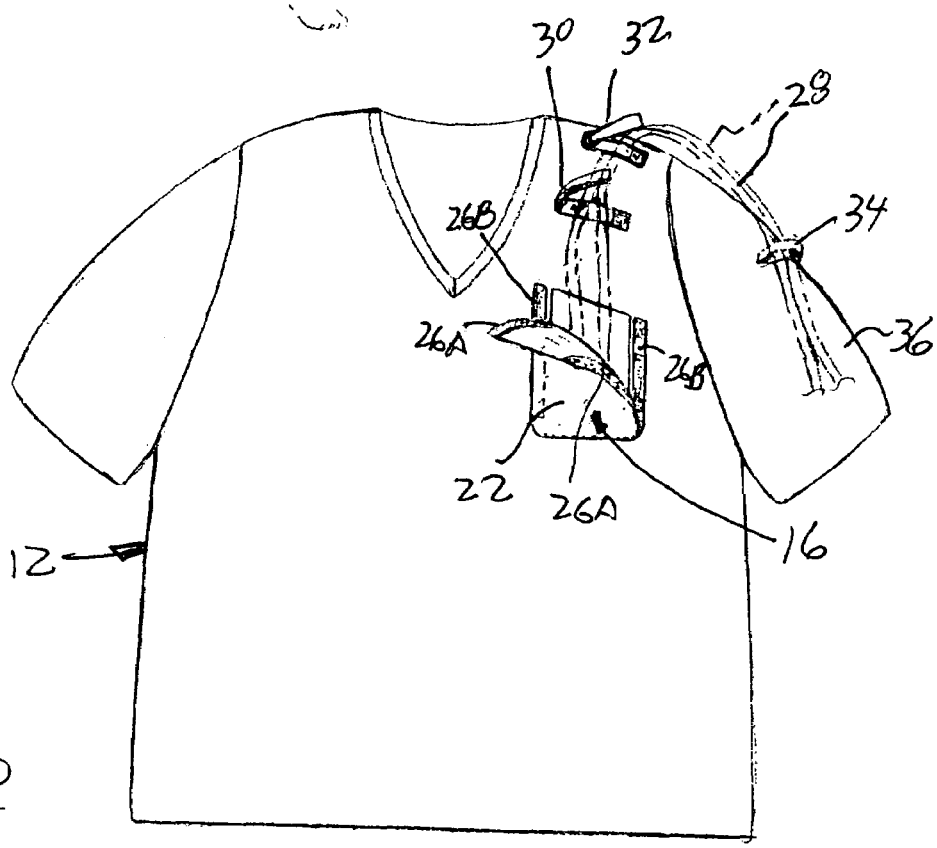
FIG. 2 is an enlarged front view of a top piece of the patient garment shown in FIG. 1.

The top piece 12 is shown in FIG. 2 in further detail, and includes an upper torso pullover with sleeves. An openable flap 16 is shown located over the upper chest. The flap 16 includes a fabric panel 22 sewn to the garment across the bottom adjacent the bottom of an opening 24 and having mating hook and loop strips 26A, 26B located on respective sides of the panel 22 and opening 24. This enables the panel 22 to be folded down to expose the opening 24 to allow access to the wearer's body at the site at the opening 24, as for insertion of tubes 28.

According to the present invention a series of loops 30, 32, 34 preferably openable are arranged from a point adjacent the opening 24 up to the top of the shoulder and down the sleeve 36 on the same side as the opening 24. The tubes 28 are routed through the strap loops 30, 32, 34 as shown to secure the tubes in proper position and allow the patient some freedom of movement without creating a danger that the tubes 28 will be pulled out by his or her motion.

Figure 3:
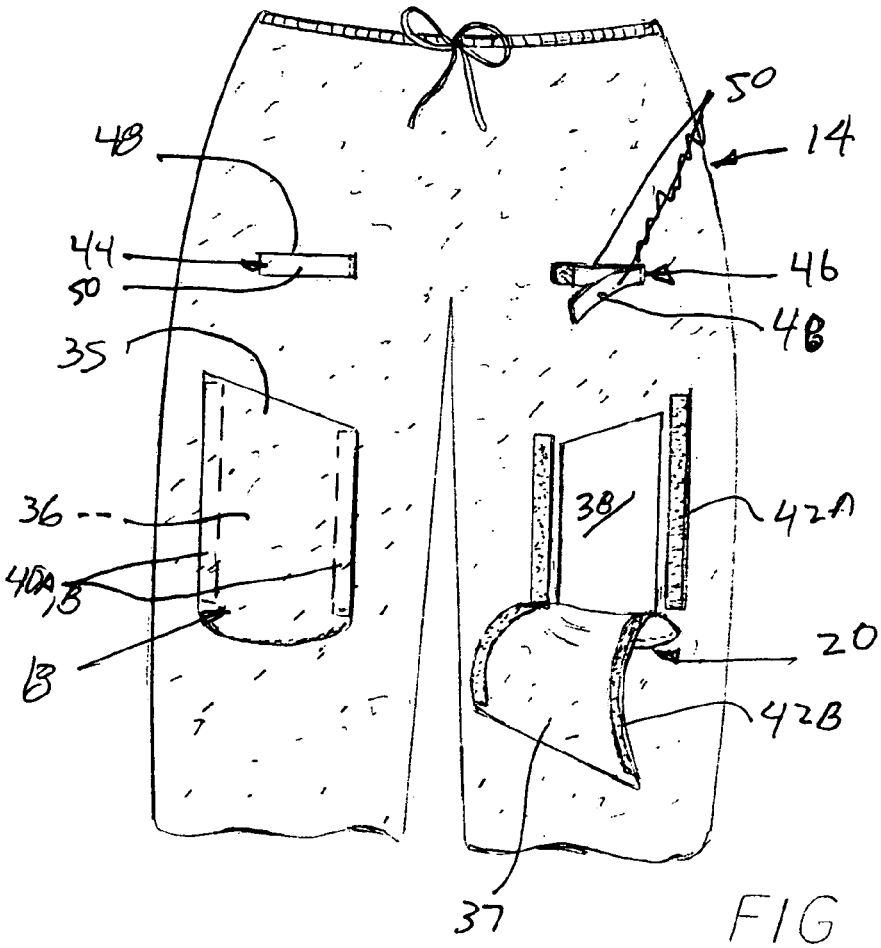
FIG. 3 is an enlarged fragmentary front view of a bottom piece of the patient garment shown in FIG. 1.
Figure 4A:
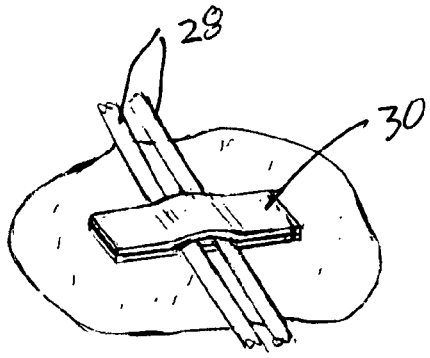
FIG. 4A is an enlarged fragmentary pictorial view of a region of the patient garment having one of the tube holder loop attached with tube segments shown held therein.
Figure 4B:
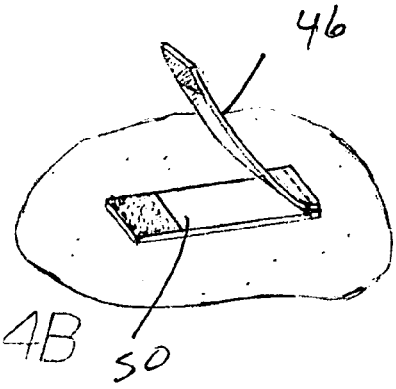
FIG. 4B is an enlarged pictorial view of the loop shown in FIG. 4A which is opened to allow a tube to be easily removed or emplaced.

Referring to FIG. 3, the bottom piece 14 resembles a pair of pants, but has a pair of openable flaps 18, 20, each including a fabric panel 35, 37 having a bottom edge sewn to one of the pants legs adjacent a respective opening 36, 38. Strips 40A, B carrying hook and loop features enable the panels 35, 37 to normally be held in position over the respective openings 35, 37 but able to be folded back when access to the wearer's body sites at those openings 35, 37 is necessary for insertion of tubes for dialysis or some other treatment or examination purposes.

A single strap loop 44, 46 is located above each openable flap 18, 20, each comprised of strips 48, 50 having patches formed with mating hook and loop features to enable tubes to be held in position above a respective access opening 35, 37.

Additional strap loops may be provided. Also, as seen in FIG. 1 additional openable flaps can be provided, as the flap 52 with strap loop 53 over the groin area. Or, the patient's garment 10 could have an openable flap 54 with strap loop 55 on the upper arm and a second right side openable flap 17 on the upper chest.

The hook and loop fasteners can be replaced with straps, buttons, etc.

The invention claimed is:

1. A patient garment to be worn during medical treatment or examination by medical personnel comprising:

a top piece configured as a pullover with sleeves to cover the upper torso and the arms of a wearer;

a bottom piece configured as a pair of pants to cover the lower torso and legs of the wearer;

at least one openable flap on each of said top piece, and bottom piece lying over a corresponding opening in each of said top and bottom pieces, each openable flap comprising a panel attached along one side to said garment adjacent one side of an associated opening, with a detachable fastener for securing said panel in position extending over said opening; and a loop affixed to the outside of said garment adjacent each openable flap adapted to receive and secure tubing passed into said garment opening covered by said flap; and a series of said loops attached to said outside of said garment leading to one of said openable flaps.

2. The patient garment according to claim 1 wherein each loop comprises a strip attached at either end to said garment.

3. The patient garment according to claim 2 wherein each strip is fixed to said garment at one end and detachably attached at the other end to form said loop.

4. The patient garment according to claim 1 wherein said series of loops are provided on said top piece comprising a loop on a sleeve portion of said top piece, a loop on a shoulder portion of said top piece and a loop on a chest portion of said top piece respectively, adjacent to an openable flap on said chest portion of said top piece to route said tubing along the arm, shoulder, and chest of a wearer.

* * * * *